US006513674B1

(12) United States Patent
Kajikawa et al.

(10) Patent No.: US 6,513,674 B1
(45) Date of Patent: Feb. 4, 2003

(54) CONTAINER FOR THE DISHES

(75) Inventors: Yasushi Kajikawa, Tokyo (JP); Masahide Inomata, Saitama (JP)

(73) Assignee: Kabushiki Kaisha Mamia, Saitama (JP)

( * ) Notice: Subject to any disclaimer, the term of this patent is extended or adjusted under 35 U.S.C. 154(b) by 0 days.

(21) Appl. No.: 09/433,709

(22) Filed: Nov. 4, 1999

(30) Foreign Application Priority Data

Nov. 13, 1998 (JP) ..... 10-323580
Sep. 27, 1999 (JP) ..... 11-271761

(51) Int. Cl.[7] ..... B65D 1/34; A47B 57/58

(52) U.S. Cl. ..... 220/572; 211/41.6; 211/198; 211/201

(58) Field of Search ..... 220/572, 487, 220/488, 486, 489, 23.2, 23.4, 23.89, 23.91, 507; 206/301.1, 555; 211/41.2–41.9, 198, 200, 201, 175

(56) References Cited

U.S. PATENT DOCUMENTS 1,079,100 A * 11/1913 Boswell et al. ..... 211/47
1,345,401 A * 7/1920 Ratner ..... 220/572
2,039,927 A * 5/1936 Poglein ..... 211/13.1
2,562,982 A * 8/1951 Cieri ..... 211/41.6
3,952,875 A * 4/1976 Lombardo ..... 211/41.6
5,234,116 A * 8/1993 Kristinsson et al. ..... 211/201
5,332,105 A * 7/1994 Stanfield ..... 211/41.4

FOREIGN PATENT DOCUMENTS

| | | |
|---|---|---|
| JP | 48-50535 | 5/1973 |
| JP | 59-154082 | 10/1984 |
| JP | 1-20323 | 2/1989 |
| JP | 1-72168 | 6/1989 |
| JP | 04067870 | 10/1992 |
| JP | 06243487 | 1/1994 |

* cited by examiner

*Primary Examiner*—Stephen P. Garbe
(74) *Attorney, Agent, or Firm*—Browdy and Neimark

(57) ABSTRACT

A bowl B in a dish-accommodating space S comes in engagement at the periphery or rim f thereof with lugs 12, which are movable relatively to reduce or expand an interval between any two adjacent bowls. On the other hand, a support plate 7 makes engagement at a concave edge 13 thereof with the periphery or rim of the bowl B and also abutment at a major surface thereof against the periphery or rim of an adjoining bowl B. That is, any one of bowls B comes in abutment against the major surface of the support plate 1 that is ahead of the bowl B. An operator first loads a conveyor of a dishwasher with a dish container 1 lying on its side and, then, expands the dish container 1. In this way, the bowls B in the dish container 1 are arranged vertically spaced apart from each other in a substantially standing posture. After the completion of the washing, the dish container 1 is contracted to a reduced state where the bowls B come in close relation with each other.

8 Claims, 12 Drawing Sheets

CONTAINER FOR THE DISHES

BACKGROUND OF THE INVENTION

1. Field of the Invention

The present invention relates to a dish container convenient for washing or rinsing dishes such as plates, bowls and others, which have been accommodated after used in, for example, the institution to provide meals.

2. Description of the Prior Art

In meal service systems for attempting to serve large number of people, typically, in the systems installed in institutions to provide food or meal in schools, hospitals or corporations, the tableware such as dishes, trays and the others has been conventionally washed accommodated racks, containers, baskets or the like. The prior art of the dish-washing systems have been disclosed in, for example, Published Unexamined Applications in Japan Nos.(Shou) 50-663, (Hei)3-10 932 and (Hei)5-269 073; Published Unexamined Utility Model Applications in Japan Nos.(Hei) 2-112 251 and (Hei)3-10 847; and Published Examined Utility Model Application in Japan No.(Hei)3-10 932.

With the prior dish containers such as baskets used in, for example, a dishwasher having nozzles to jet or spray out cleaning liquid or warm water, it is preferred to hold therein dishware in a relation that any two adjacent dishes are spaced apart away from each other to allow the cleaning liquid to wash the dishes thoroughly to thereby help ensure the reliable washing performance. To deal with this, most prior dish containers have fingers and partitions to space the adjacent dishes apart from away from one another. Of the citations described just above, Published Examined Utility Model Application in Japan No.(Hei)3-10 932 and Published Unexamined Utility Model Applications in Japan No.(Hei)3-10 847 may be referred to. With prior dish containers of this type, a service personnel in a cafeteria has been plagued with a troublesome task of accommodating soiled dishes once by one in each divided compartment in the container.

In contrast, as will be seen from the above cited Published Unexamined Applications in Japan No.(Hei)5-269 073, an integrated system has been proposed in which the dishes remain accommodated in the containers during not only treatment at the meal processing station but also delivery from the processing station to serveries, which are customers, or schools in school meal system. In accordance with this prior integrated system for delivering meals, the tableware is carried from the meal processing station to the school, with being accommodated in groups at every class of the school in the conventional type of containers having the fingers and partitions as cited above. Every student or child returns his own soiled dishes into each compartment in the containers after a meal. Following conveyance of the soiled dishes with the container to the meal processing station, an operator charges the containers remained accommodating therein the soiled dishes into the dishwasher, with not having to touch any soiled dish, in which the soiled dishes are washed. After the completion of washing, the clean dishes stay accommodated in the containers for a meal next day. Moreover, Published Unexamined Application in Japan No. (Hei)8-72 872 discloses a basket suitable for the integrated system explained above, in which stainless rods define each compartment for individual dish.

With the integrated meal service system of the type described above, the soiled dishes or bowls are carried into the compartments in the containers, one to each compartment, by every customer, or student or child, in such a manner that the any adjoining soiled dishes are arranged spaced apart away from each other for efficient washing. Then, containers accommodating therein the soiled dishes are returned to the meal processing station, where the soiled dishes remaining held in the containers are put into the dishwasher so that the operators may carry out the washing of the dishes in the containers with no touch of the soiled dishes. The dishes washed away from soiling are conveyed, with having remained accommodated in the containers, from the meal processing station to the schools. Consequently, the tableware may be repeatedly carried in remaining held in the containers for reuse between the meal processing station and the schools. It will be thus said that the integrated meal service system is very superior in sanitation because the operators do not touch the tableware with their hands throughout the operations on washing at the meal processing station and the conveyance between the processing station and the institutions such as schools.

Nevertheless, the conventional containers such as baskets as described above are designed to provide many compartments defined with the fingers or partitions, where the tableware is contained, one to each compartment, spaced apart away from each other with a preselected interval. This makes the container bulky in volume compared with the dishes only stacked up one on top of another, resulting in disadvantages of requiring heavy vehicles, or heavy trucks, to convey the containers packed with the dishes from the meal processing station to the schools and vice versa, and also requiring large open space to stock the containers ready for next use.

SUMMARY OF THE INVENTION

A primary object of the present invention is to provide a dish container expansible in a space between any adjacent dishes accommodated in the container.

Another object of the present invention is to provide a dish container capable of expanding a space between any adjacent dishes on washing event while reducing the space between any adjacent dishes on conveyance and/or storage event where the container is required to be made less in volume.

In an aspect of the present invention to cope with the objects described above, a dish container is disclosed, comprising U-shaped frame members arranged in juxtaposition to define dish-accommodating spaces to receive therein dishes, paired link members connected to sidewise opposing portions of the U-shaped frame members and also connected any adjacent U-shaped frame member to close up an d separate away any two adjacent U-shape frame members with respect to each other, support plates extending between the paired link members, paired lugs provided at sidewise opposing upper ends of the U-shaped frame members to extend into the dish-accommodating spaces, wherein any clearance between any two adjacent lugs when the U-shaped frame members come in close contact with each other is substantially equal to a clearance between any two adjoining rims of stacked dishes to be accommodated in the dish container, and wherein any dish in the associated dish-accommodating space comes at its outer surface in engagement with an edge of the adjoining support plate and also at its rim in engagement with the lugs, and further comes at its rim in abutment against another support plate ahead of the dish, whereby the dishes received in the dish-accommodating spaces move apart from each other when the U-shaped frame members are separated from each other and, in contrast, move in close contact with each other when the U-shaped frame members are brought into contact with each other.

In another aspect of the present invention to deal with the above-mentioned objects, a dish container is disclosed, comprising U-shaped frame members arranged in juxtaposition to define dish-accommodating spaces to receive therein dishes, a pair of sidewise opposing upper link members and a pair of sidewise opposing lower link members connected to sidewise opposing portions of the U-shaped frame members and also connected any adjacent U-shaped frame member to close up and separate away any two adjacent U-shape frame members with respect to each other, support plates extending between the paired sidewise opposing lower link members, paired lugs provided ate sidewise opposing upper ends of the U-shaped frame members and/or the upper link members to extend into the dish-accommodating spaces, wherein any clearance between any two adjacent lugs when the U-shaped frame members come in close contact with each other is substantially equal to a clearance between any two adjoining rims of stacked dishes to be accommodated in the dish container, and wherein any dish in the associated dish-accommodating space comes at its outer surface in engagement with an edge of the adjoining support plate and also at its rim in engagement with the lugs, and further comes at its rim in abutment against another support plate ahead of the dish, whereby the dishes received in the dish-accommodating spaces move apart from each other when the U-shaped frame members are separated from each other and, in contrast, move in close contact with each other when the U-shaped frame members are brought into contact with each other.

In another aspect of the present invention to deal with the objects described above, a dish container is disclosed, comprising U-shaped frame members arranged in juxtaposition to define dish-accommodating spaces to receive therein dishes, the U-shaped frame members being made so high as to conceal entirely the dishes in the dish-accommodating spaces, paired link members connected to sidewise opposing portions of the U-shaped frame members and also connected any adjacent U-shaped frame member to close up and separate away any two adjacent U-shape frame members with respect to each other, support plates extending between the paired link members, paired lugs provided at sidewise opposing upper ends of the U-shaped frame members to extend into the dish-accommodating spaces, latch means embracing the overall U-shaped frame members to keep the U-shaped frame members on a state where the U-shaped frame members come in close contact with each other, and stopper means to obstruct open sides of the U-shaped frame members to keep the dishes against falling off from the dish accommodating spaces where the dishes are received, wherein any clearance between any two adjacent lugs when the U-shaped frame members come in close contact with each other is substantially equal to a clearance between any two adjoining rims of stacked dishes to be accommodated in the dish container, and wherein any dish in the associated dish-accommodating space comes at its outer surface in engagement with an edge of the adjoining support plate and also at its rim in engagement with the lugs, and further comes at its rim in abutment against another support plate ahead of the dish, whereby the dishes received in the dish-accommodating spaces move apart from each other when the U-shaped frame members are separated from each other and, in contrast, move in close contact with each other when the U-shaped frame members are brought into contact with each other.

In a further another aspect of the present invention to cope with the objects described above, a dish container is disclosed, comprising U-shaped frame members arranged in juxtaposition to define dish-accommodating spaces to receive therein dishes, the U-shaped frame members being made so high as to conceal entirely the dishes in the dish-accommodating spaces, a pair of sidewise opposing upper link members and a pair of sidewise opposing lower link members connected to sidewise opposing portions of the U-shaped frame members and also connected any adjacent U-shaped frame member to close up and separate away any two adjacent U-shape frame members with respect to each other, support plates extending between the paired sidewise opposing lower link members, paired lugs provided at any one of sidewise opposing upper ends of the U-shaped frame members and the upper link members to extend into the dish-accommodating spaces, latch means embracing the overall U-shaped frame members to keep the U-shaped frame members on a state where the U-shaped frame members come in close contact with each other, and stopper means to obstruct open sides of the U-shaped frame members to keep the dishes against falling off from the dish-accommodating spaces where the dishes are received, wherein any clearance between any two adjacent lugs when the U-shaped frame members come in close contact with each other is substantially equal to a clearance between any two adjoining rims of stacked dishes to be accommodated in the dish container, and wherein any dish in the associated dish-accommodating space comes at its outer surface in engagement with an edge of the adjoining support plate and also at its rim in engagement with the lugs, and further comes at its rim in abutment against another support plate ahead of the dish, whereby the dishes received in the dish-accommodating spaces move apart from each other when the U-shaped frame members are separated from each other and, in contrast, move in close contact with each other when the U-shaped frame members are brought into contact with each other.

Other objects and features of the present invention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DETAILED DESCRIPTION OF THE PREFERRED EMBODIMENTS

Preferred embodiments of the present invention will be described hereinafter in conjunction with the accompanying drawings.

Figure 1:
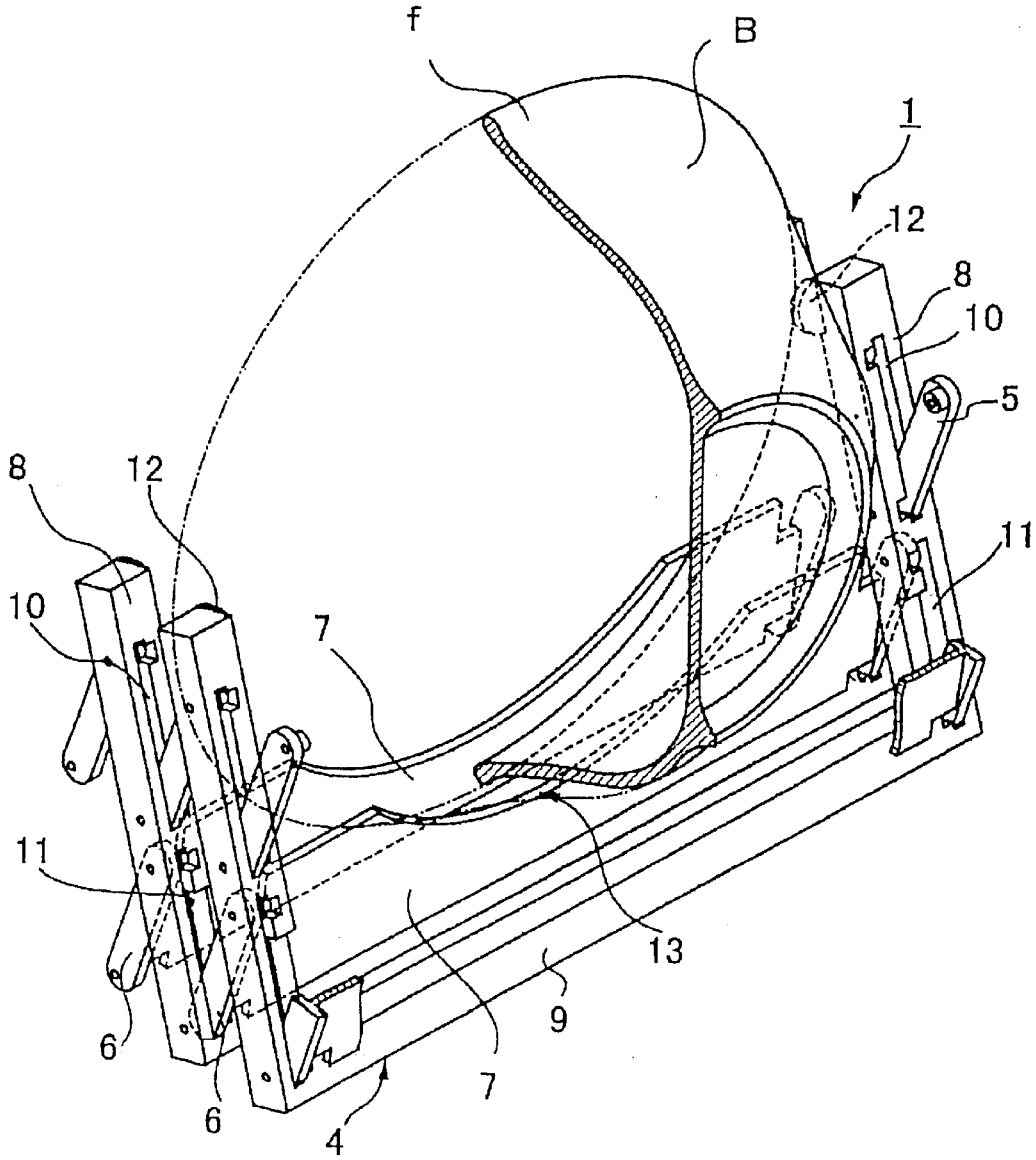
FIG. 1 is a fragmentary perspective view, partially in section and partially in phantom, showing a dish container in accordance pith a preferred embodiment of the present invention.
Figure 2:
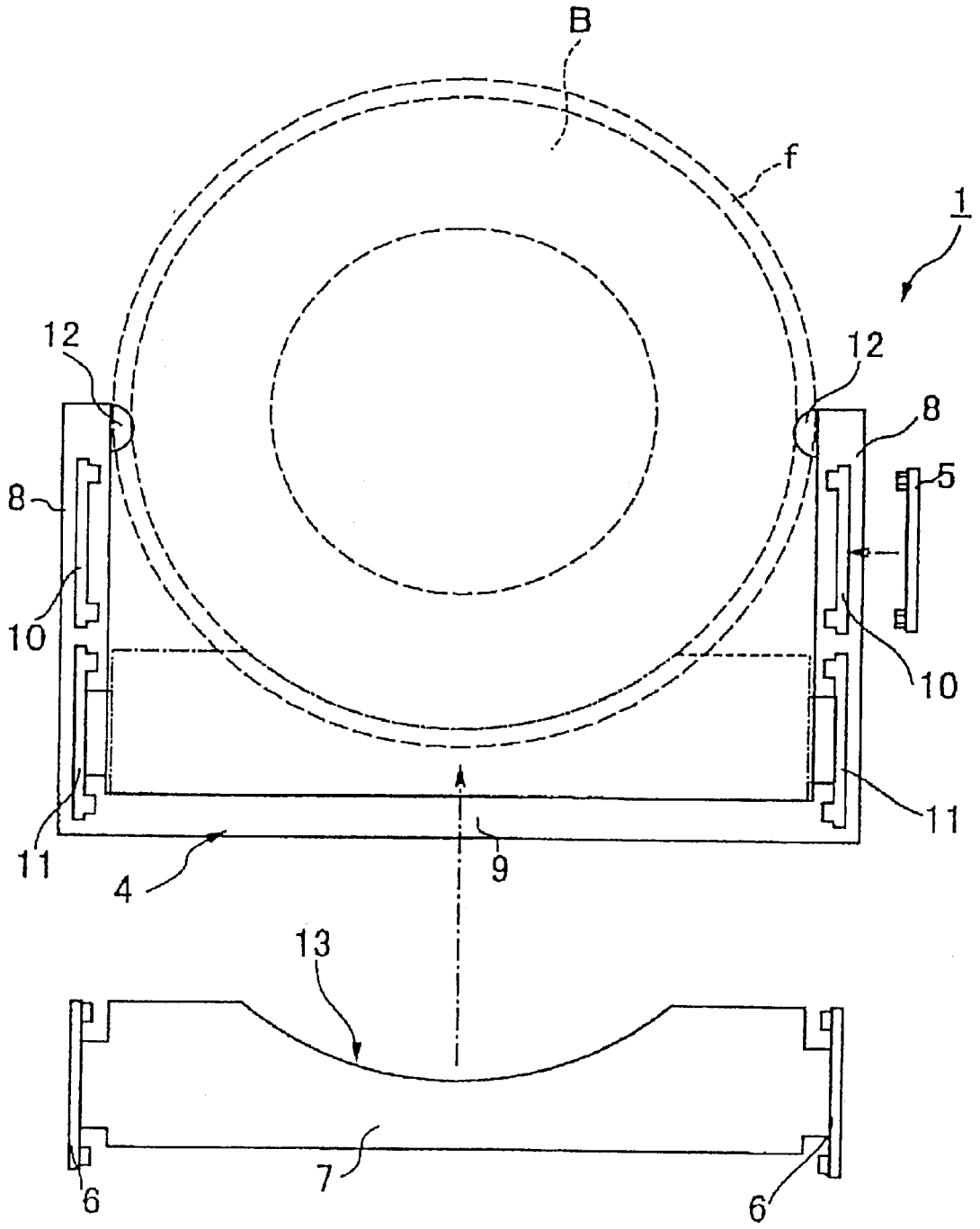
FIG. 2 is an exploded front elevation showing the dish container in accordance with the preferred embodiment of the present invention.
Figure 3:
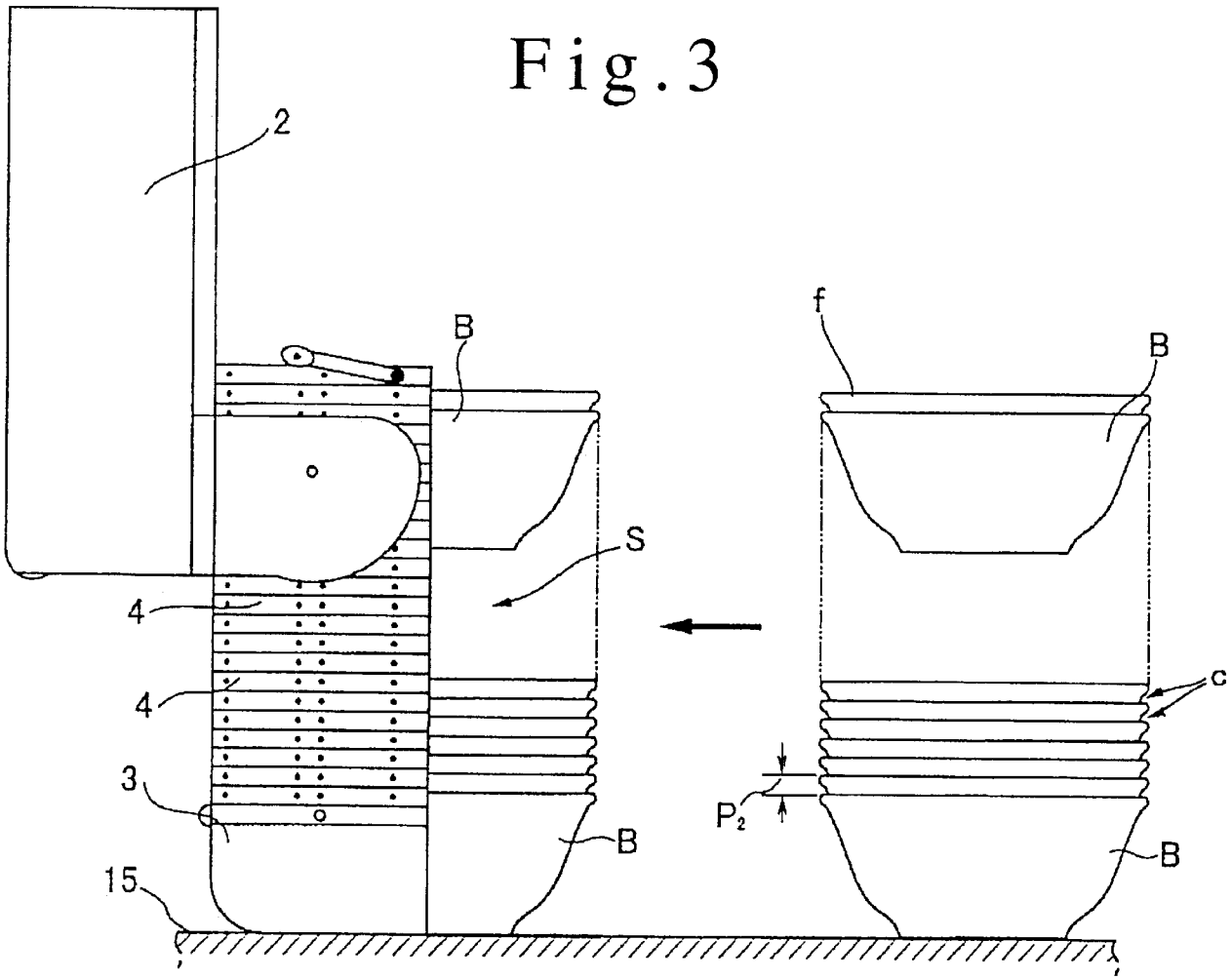
FIG. 3 is a schematic view explaining how to accommodate the dishes in the container constructed in accordance with the present invention.
Figure 4:
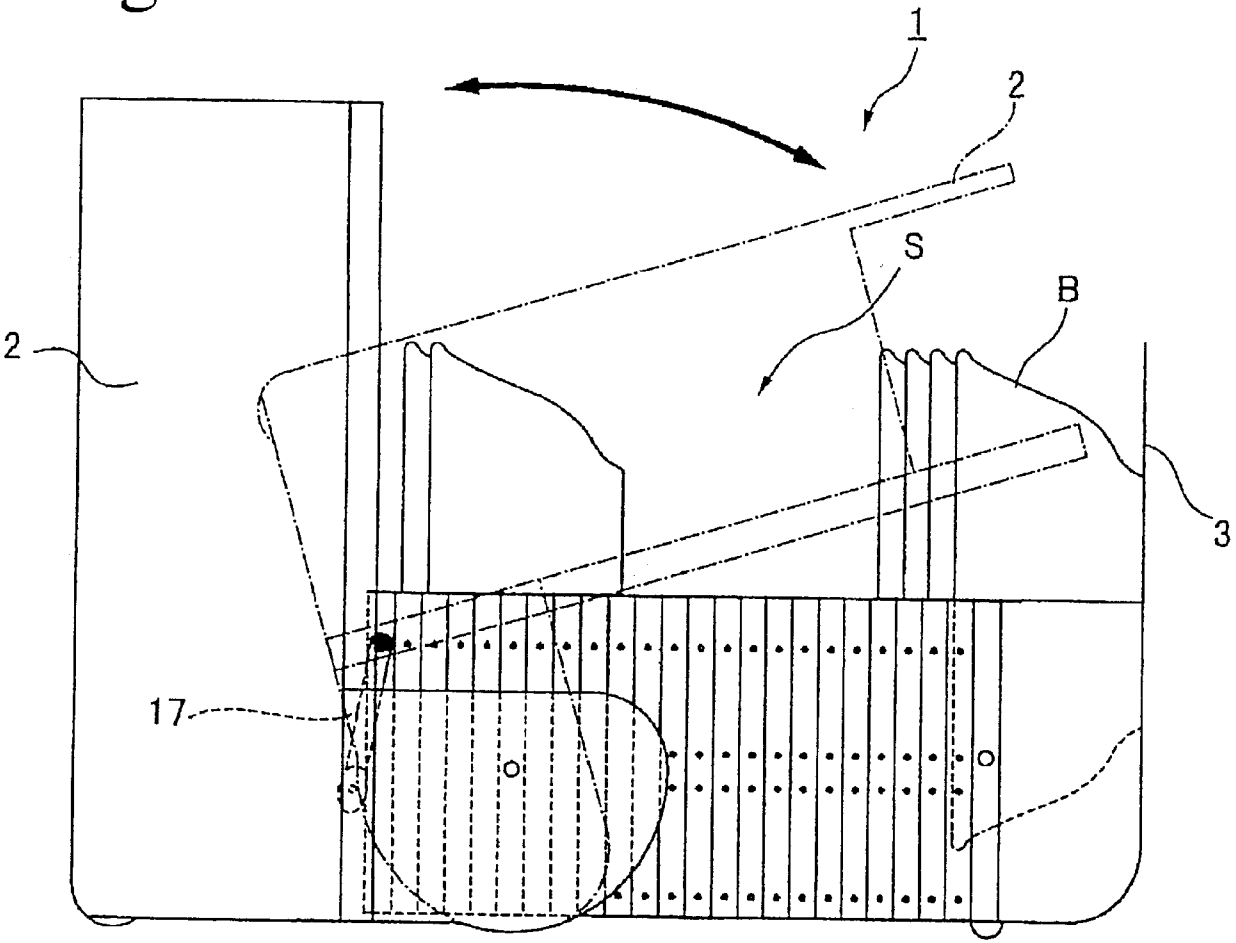
FIG. 4 is a schematic view explanatory of how to close the container after the dishes have been accommodated therein.

Referring now in detail to FIGS. 1 and 2, reference numeral 1 denotes a dish container constructed in accordance with a preferred embodiment of the present invention to accommodate therein a bowl for soup served at school meals. As shown in FIGS. 3 and 4 the dish container 1 is comprised of a pair of covers, or upper cover 2 and bottom cover 3, U-shaped frame members 4 arranged in juxtaposition with each other, paired upper and lower link members 5, 6 to connect any adjoining frame members 4 with each other at sidewise opposing locations of the frame members, and support plates 7 arranged extending between the sidewise opposing lower link members 6 and 6. The components or members described lust above are preferably made of a substance light in weight such as aluminum and synthetic resins to render the container less in gross weight.

Figure 5:
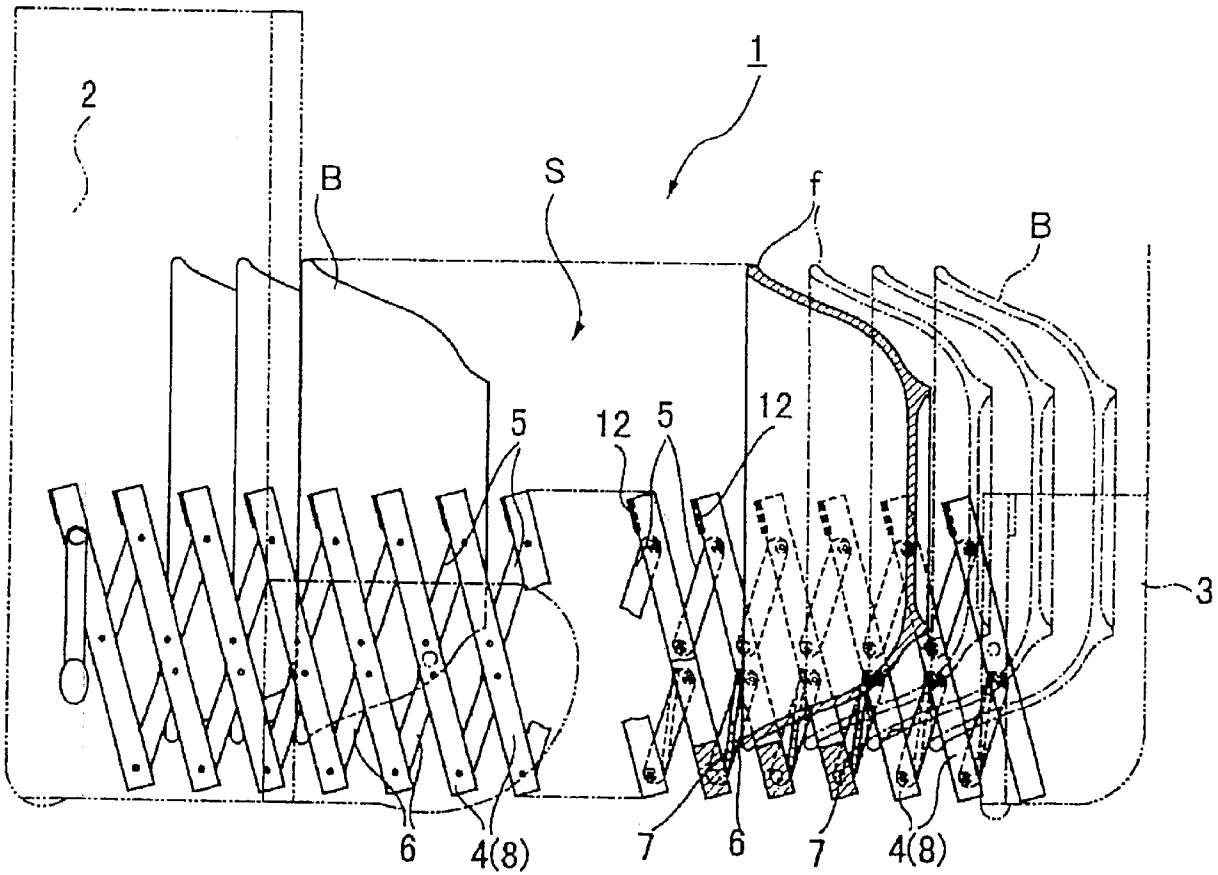
FIG. 5 is a schematic view explaining a posture of the dish container in accordance with the present invention, where the dishes are washed, remaining accommodated in the container that is expanded to space any adjacent dishes apart away from each other.

For easy understanding of the invention, the comprehensive operation of the dish container will be first explained roughly. The dish container 1 of the present invention may selectively take either one of two different states: a reduced posture where any adjoining U-shaped frame members 4 come in contact or abutment with each other (refer to FIGS. 3 and 4) and an expanded posture where any adjoining U-shaped frame members 4 are spaced apart from each other (refer to FIG. 5). That is to say, clearances between any adjacent U-shaped frame members 4 are expansible from the reduced state where bowls B are nested in the container in a relation overlaid one on top of another to the expanded state where the bowls B kept at a relation spaced apart from each other.

Each U-shaped frame member 4 is composed of a pair of sidewise opposing upright posts 8 and a horizontal bar 9 having a rectangle in cross-section and connecting the upright posts 8 at their lower ends. The U-shaped frame member 4 provides an upwardly-opened space S defined by the sidewise opposing upright posts 8 and horizontal bar 9, as seen looking at the U-shaped frame member 4 from the front thereof, in which space S is inserted a bowl B for the extent about half the diameter thereof. The sidewise opposed upright posts 8 of any U-shaped frame members 4 are pivotally connected to any adjacent upright post 8 of the next U-shaped frame member 4 through the upper and lower link members 5 and 6 to form parallelogrammic linkages, which allow the U-shaped frame members 4 to move from the nested state to the expanded state and vice versa, keeping the parallel relation between) any two adjoining U-shaped frame members 4.

As will be best understood from FIG. 2, the upright posts 8 of the U-shaped frame member 4 are made with upper recesses 10 and lower recesses 11 at their surfaces confronting the adjacent frame members 4 to receive therein the associated upper and lower link members 5 and 6. With the reduced state where the U-shaped frame members 4 are nested together, the upper and lower link members 5 and 6 are allowed to fit in the associated recesses 10 and 11 and, therefore, the adjoining U-shaped frame members 4 may come in substantially close contact together.

Moreover, the sidewise opposing upright posts 8 of the U-shaped frame members 4 are provided at their upper ends with lugs 12 extending towards each other. The support plate 7 extending between the sidewise opposing lower link members 6, as apparent from FIG. 2, is formed at its upper edge 13 facing to the upwardly-opened space in a concave contour substantially complementary to the periphery of the bowl B to be accommodated.

Figure 6:
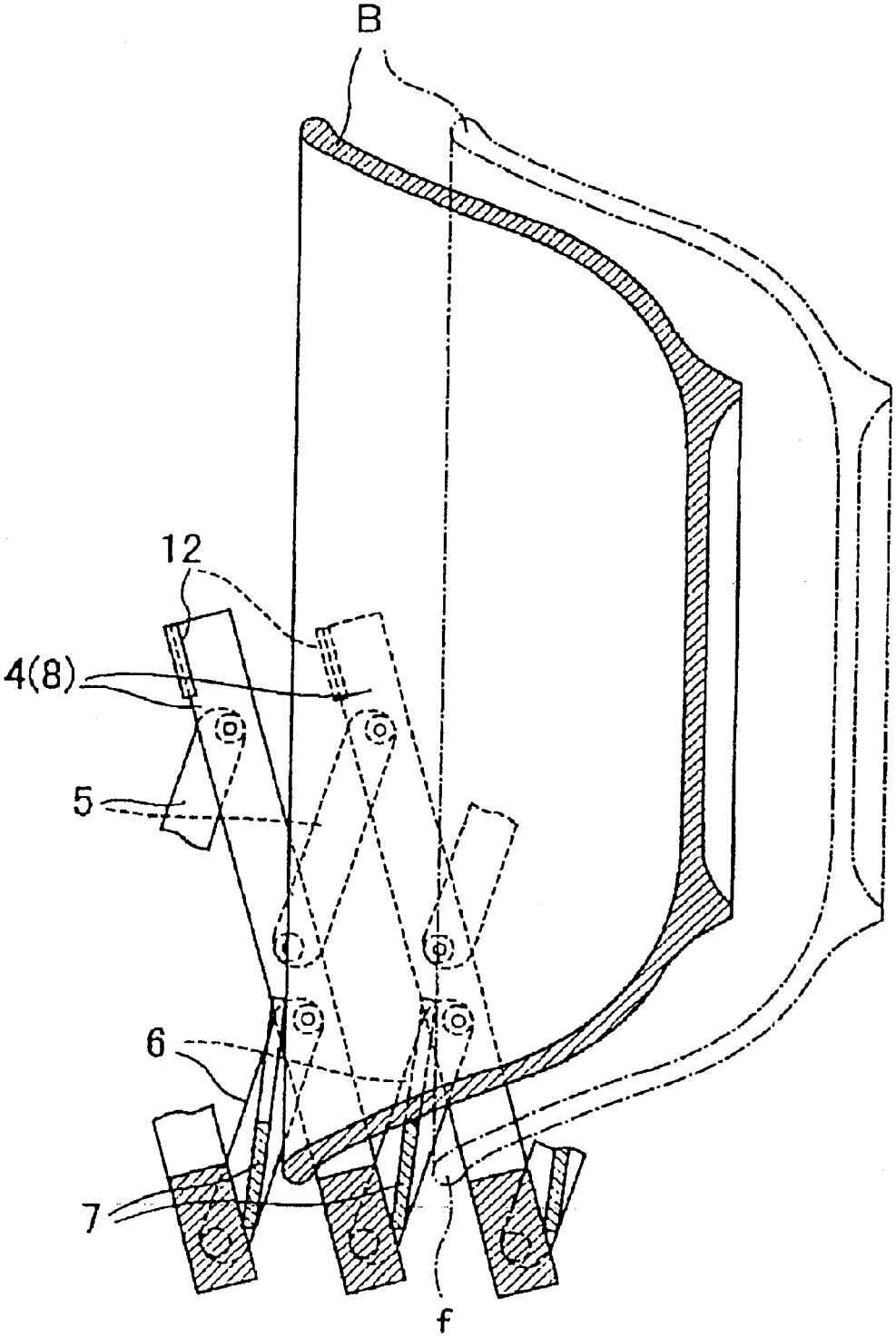
FIG. 6 is a fragmentary perspective view, partially in section and partially in phantom, showing a dish container in accordance with the present invention to explain how the accommodated dishes come in engagement with lugs and support plates.

Referring FIGS. 1 and 6, the lugs 12 and support plate 7 will be described in detail hereinafter. The lugs 12 are to make engagement with the periphery or rim f of the bowl B accommodated in the associated space S. In contrast, the support plate 7 comes in engagement with the outer surface of the bowl B at the concave edge 13 thereof and also abutment with the periphery or rim of the adjacent bowl B at the major surface thereof. In other words, now considering any one bowl B, the periphery or rim of the bowl B comes in abutment against the major surface of the support plate 7 that is just ahead of the bowl B. Consequently, the bowl B is supported with the cooperation of the lugs 12 with support plate 7. Keeping the bowl B against falling on its back or keeping the bowl B on its standing attitude is ensured by the engagement of the rim of the bowl B with the support plate that is ahead of the bowl B. Although the concave edge 13 of the support plate 7 in the embodiment described above is formed in roughly complementary contour with the bowl B so as to function on line contact with the outer surface of the bowl B, the concave edge 13 may be for example made uneven to function on point contact. If only one point contact may be sufficient, the concave edge 13 is preferably raised at a middle area thereof towards the space S.

The following will explain as to how to use the dish container of the present invention in connection with the container 1 constructed just as described above for, but is not limited to, soup bowls.

After a meal, each customer, or student or child stacks the soiled bowls B on a table 15 as shown in FIG. 3. With all the dirty bowls B having been stacked up one on top of another, the dish container 1 is laid on the bottom cover 3 with the upper cover 2 open, as shown in FIG. 3. In this event, the dish container 1 is completely reduced with the space S of the dish container 1 open for the stacked bowls B.

Then, by moving the stacked bowls B towards the dish container 1, the bowls B are received in the dish container 1. Meanwhile, any clearance P1 between the confronting lugs 12 of the adjoining frame members 4 at the reduced posture of the dish container 1 is designed equal to any interval P2 between the confronting rims of any two adjacent bowls B out of the stacked bowls B. Alignment in height of any lug 12 of the U-shaped frame member 4 with any clearance C between the confronting rims of the a bowls B may be maintained by the adjustment of the bottom case in height when the dish container 1 is laid on the bottom cover 3 down.

After accommodating the stacked bowls B in the dish container 1 according to the manner as described above, the dish container 1 is inverted and the upper cover 2 is turned to its closing position where it is locked to the bottom cover 3 with hooks, not shown. To carry the dish container having held therein the stacked bowls, thus, the operator has only to grip a handle (not shown). The dish container may be carried with remaining stacked bowls B therein and, therefore, the container 1 maybe limited to the minimum volume necessary for accommodating the stacked bowls B.

The dish container 1 with the bowls B accommodated is packed in a box together with other tableware, cans for food or the like and conveyed in a vehicle to the meal processing station, where the conveyed objects are taken out from the box for washing. Now considering the operation of the dish container 1 accommodating the bowls B, the operator first loads a conveyor of the dishwasher, not shown, with the dish container 1 lying on its side. If necessary, the opposed upper and bottom covers 2 and 3 are moved to separate apart from each other. In this way, the bowls B in the dish container 1 are arranged vertically spaced apart from each other in such a substantially standing posture as apparent from FIG. 5. This dish container 1 is typically suitable for used in the dishwasher having nozzles to spray out rinsing liquid or warm water. After the completion of washing, the operator forces the upper and bottom covers 2 and 3 towards each other to make the dish container reduced. Thus, the dish container with the clean bowls B may be stored in the reduced state of minimum volume for next use so that the minimum storing space may be sufficient.

The dish container 1 in accordance with the present invention has been described above as related to the embodiment in which the bowl B is inserted in the space S of the U-shaped frame members 4 to the extent of only half the diameter thereof and entirely concealed with the upper and bottom covers 2 and 3 Nevertheless, a modification may be made in which only the U-shaped frame member conceals the whole bowl or dish and therefore no cover or lid may be necessary.

Figure 7:
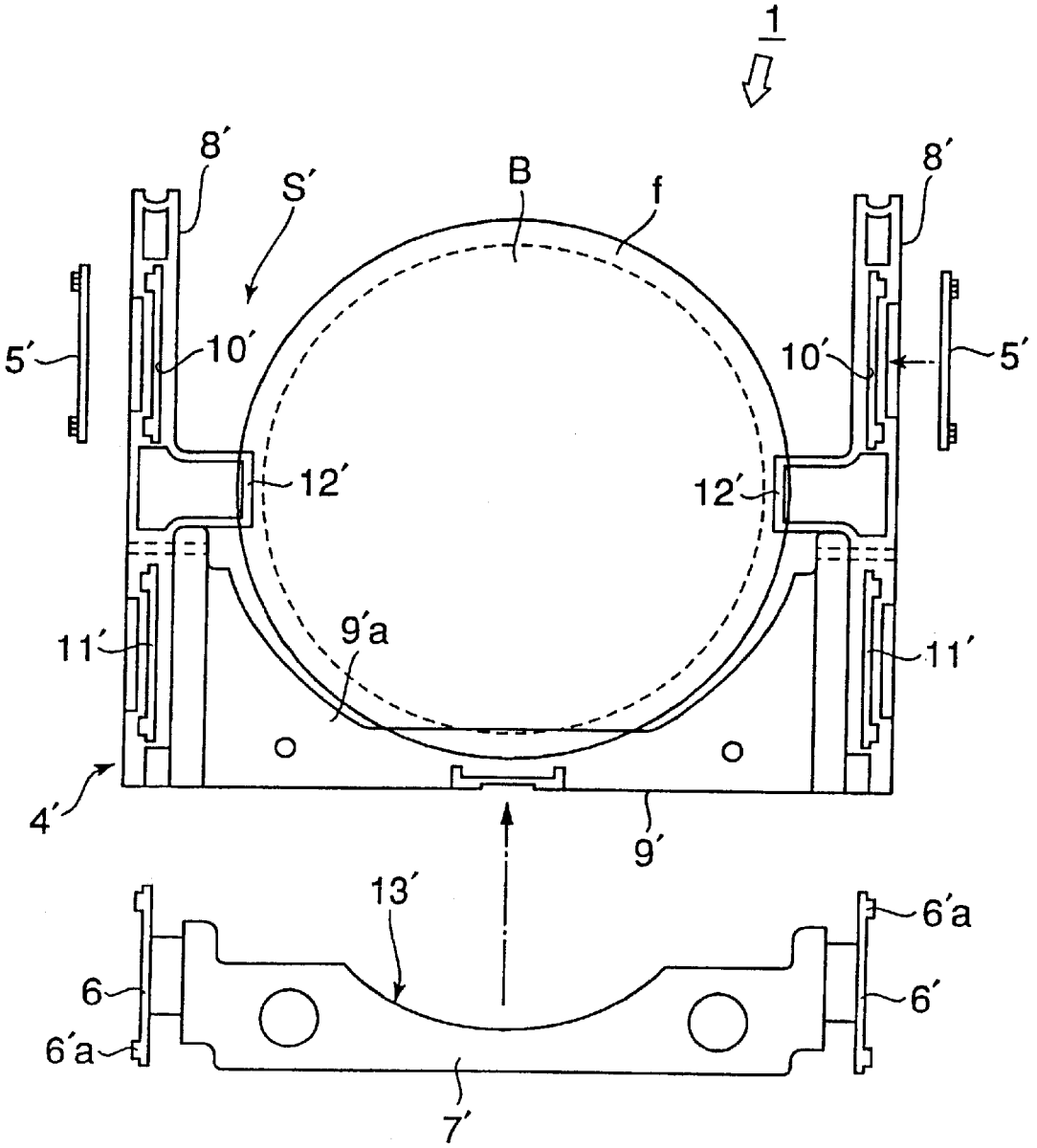
FIG. 7 is an exploded front elevation showing a dish container in accordance with another embodiment of the present invention.
Figure 8:
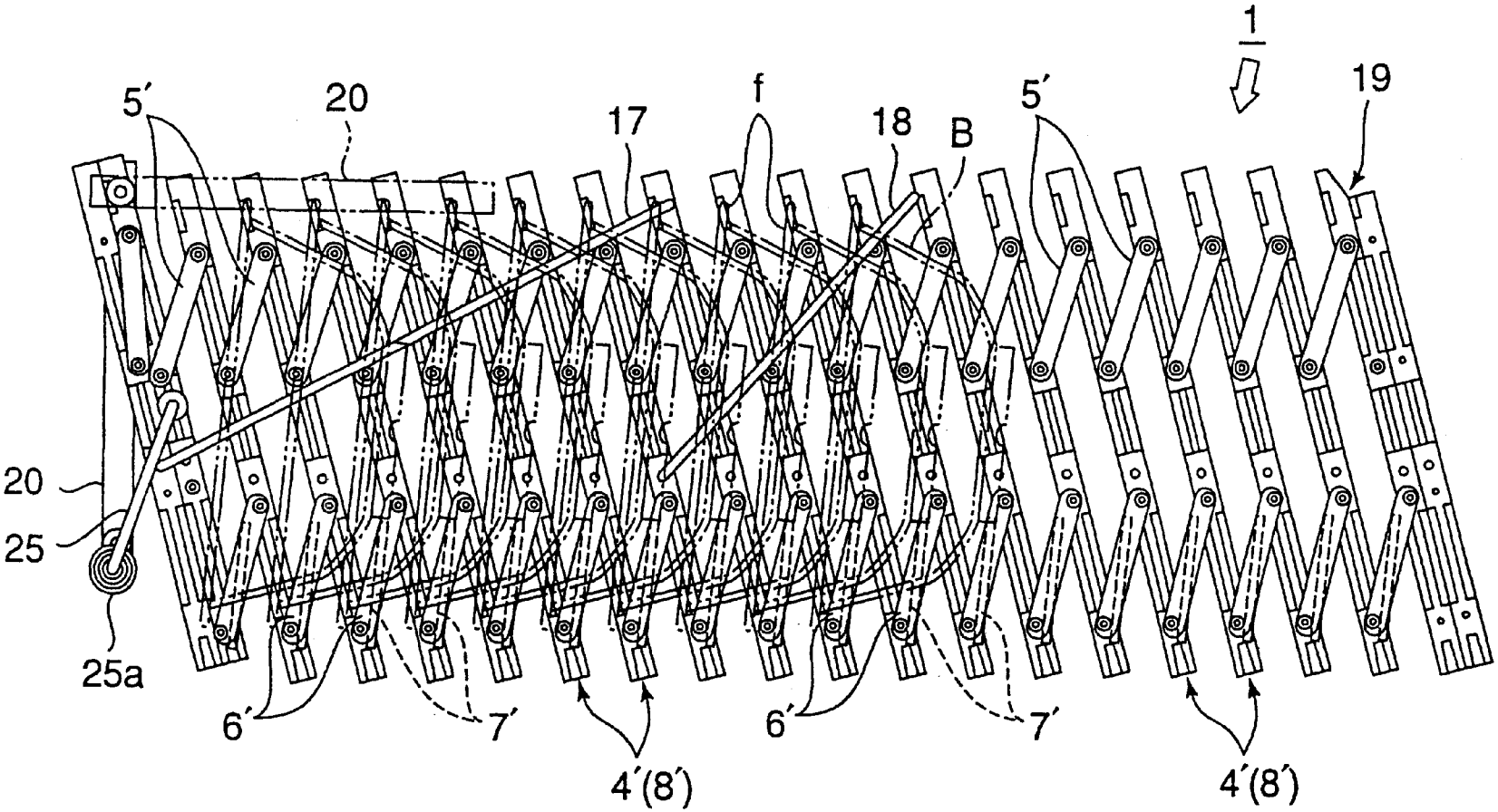
FIG. 8 is a side elevation of the dish container in accordance with the another embodiment of the present invention, which is lying sideways and expanded to space any adjacent dishes apart away from each other.

Referring to FIGS. 7 and 8, the reference numeral 1' denotes a dish container constructed in accordance with another embodiment of the present invention. The dish container 1' is comprised of U-shaped frame members 4' arranged in juxtaposition with each other, upper and lower link members 5' and 6' connected any two adjacent U-shaped frame members 4' to each other, and support plate 7' each extending between any pair of the sidewise opposing link members 6'. The components described just above are also made of substance light in weight such as aluminum and synthetic resins to render the container less in gross weight, likewise with the components in the former embodiment described above.

Figure 9:
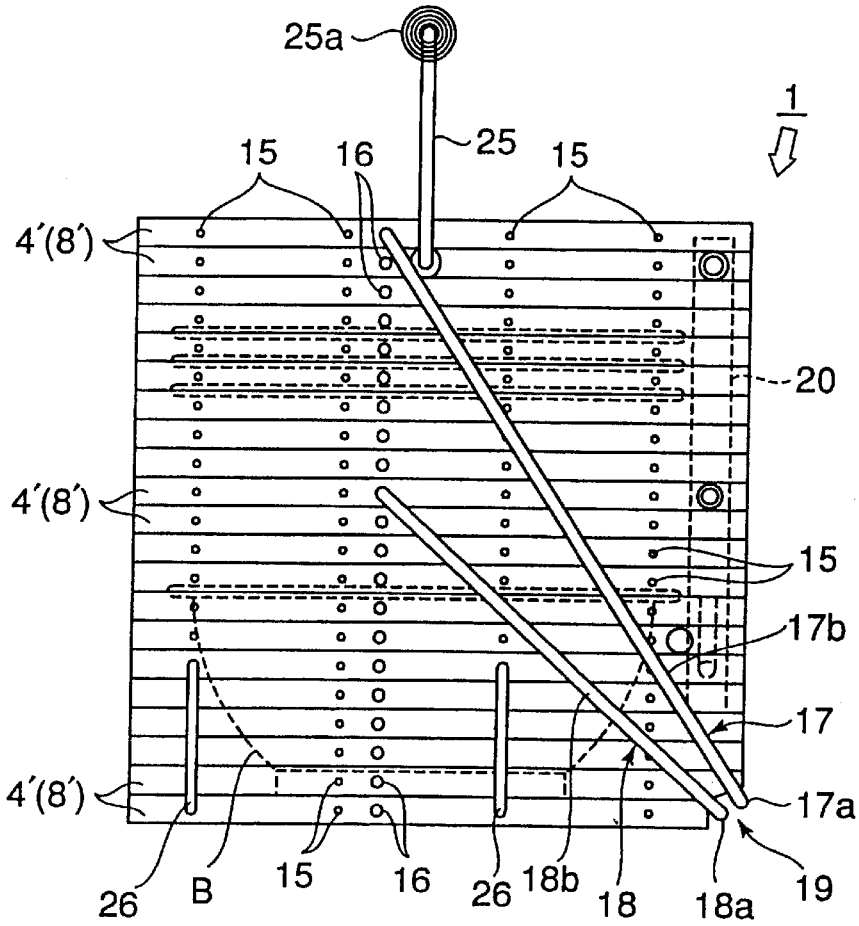
FIG. 9 is a side elevation of the dish container in accordance with the another embodiment of the present invention, which is in reduced or nested posture to contain the dishes therein for carrying, as seen looking at the side of concealing the accommodated dishes.

The dish container 1' may selectively take either one of two different states: a reduced posture where any adjoining U-shaped frame members 4' come in contact or abutment with each other (as shown in FIG. 9) and an expanded posture where any adjoining U-shaped frame members 4' are spaced apart from each other (as shown in FIG. 8). On the reduced posture, any adjacent U-shaped frame members 4 are the bowls B are nestled in the container in a relation overlaid one on top of another. On the other hand, the bowls B are kept at a relation spaced apart from each other in the expanded posture.

Each U-shaped frame member 4' is, as shown in FIG. 7, composed of a pair of sidewise opposing upright posts 8' and a horizontal bar 9' having a rectangle in cross-section and connecting the upright posts 8' at their lower ends. The U-shaped frame member 4' provides an upwardly-opened space S' defined by the sidewise opposing upright posts 8' and horizontal bar 9', as seen looking at the U-shaped frame member 4' from the front thereof. The bowls B are each inserted in the space S' to be entirely concealed in the space S'. The sidewise opposed upright posts 8' of any U-shaped frame members 4' are pivotally connected to any adjacent upright post 8' of the next U-shaped frame member 4' through the upper and lower link members 5' and 6' to form parallelogrammic linkages, which allow the U-shaped frame members 4' to move from the nested state to the expanded state and vice versa, keeping the parallel relation between any two adjoining U-shaped frame members 4'.

The sidewise opposing upright posts 8' of the U-shaped frame member 4' have a height sufficient to conceal the entire of the bowl or dish inserted in the space S'. Moreover, the upright posts 8' are made with upper recesses 10' and lower recesses 11' at their surfaces confronting the adjacent frame members 4' to receive therein the associated upper and lower link members 5' and 6'. With the reduced posture where the U-shaped frame members 4' are nested together, the upper and lower link members 5' and 6' are allowed to fit in the associated recesses 10' and 11' and, therefore, the adjoining U-shaped frame members 4' may come in substantially close contact together. In addition, the upper and lower recesses 10' and 11' are partially enlarged at the opposite ends thereof in correspondence with projections on the opposite ends of the link members. It will be seen that the projections on the link members extend sidewise outwardly, contrary to the above-mentioned embodiment.

The sidewise opposing upright posts 8' are each provided at the substantially middle height thereof with a rectangular lug 12' extending towards the center of the space S. As shown in FIG. 9, the side wise opposing upright posts 8' are moreover made on outward surfaces thereof with latch holes bored spaced apart from each other with an adequate interval. Each upright post 8' is also provided on outward surface thereof with an insert hole 16 bored nearby the middle location of the post.

The horizontal bar 9' of the U-shaped frame member 4', as shown in FIG. 7, includes a mounting plate 9'*a* that is made concave at its upper middle area. A support plate 7 is attached on the mounting plate 9'*a*.

Figure 10:
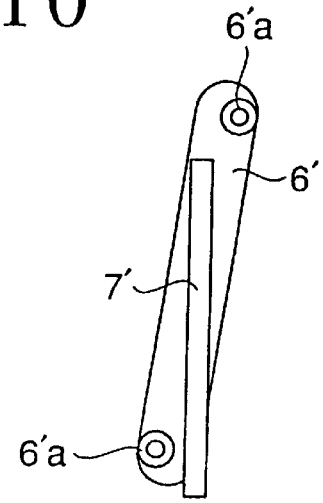
FIG. 10 is a side elevation explanatory of a relation of a lower link member with a support plate.

The support plate 7' is formed at its upper edge 13 facing to the dish-accommodating space S', in a conclave contour substantially complementary to the periphery of the bowl B to be accommodated. Fixed on the sidewise opposing ends of the support plate 7' are lower link members 6' with pivots 6*a*' thereof facing sideways outwardly of the U-shaped frame member. As apparent from FIG. 10, the lower link members 6' are each arranged off-center and aslant at suitable angle with respect to the support plate 7'.

How the lugs 12 and the support plate 7' function will be now described with reference to FIGS. 7 and 8. The lugs 12' are to make engagement with the periphery or rim f of the bowl B accommodated in the associated space S'. In contrast, the support plate 7' comes in engagement with the outer surface of the bowl B at the concave edge 13' thereof and also abutment with the periphery or rim of the adjacent bowl B at the major surface thereof. In other words, now considering any one bowl B, the periphery or rim of the bowl B comes in abutment against the major surface of the support plate 7' that is just ahead of the bowl B. Consequently, the bowl B is supported with the cooperation of the lugs 12' with, support plate 7'. Further, the bowls B inserted in the associated dish-accommodating space S' are kept aslant at a preselected angle in such a state that the U-shaped frame members 4' are spaced apart away from each other.

The dish container 1' has latch members 17, 18 to embrace the overall U-shaped frame members 4', which are moved into the reduced state, thereby keeping the dish container 1' on closure state, as will be seen from FIG. 9.

The latch members 17, 18 are each made of a rod bent in a substantially shallow U-shaped configuration, which comprises a long section 17*a*, 18*a*, short sections 17*b*, 18*b* at the lengthwise opposing ends of the long section 17*a*, 18*a*, and hooks, not shown, formed by bending inwardly the distal ends of the short sections in a L-shape. In this embodiment, any one 18 of the latch members is formed shorter in its short sections 18*b* than that of the other latch member 17.

With the dish container 1' of the reduced state, the long section 17*a* of the latch member 17 is kept on engagement with a notch 19, which is formed in the lowest-lying U-shaped frame member 4' (viewed in FIG. 9) and the adjoining U-shaped frame member 4 at their open-sided edges (right hand viewed in FIG. 9). The hooks of the latch member 17 are fitted in the insert holes 16 in the uppermost-lying U-shaped frame member 4'. Similarly, the long section 18*a* of the latch member 18 is kept on engagement with the notch 19, while the hooks of the latch member 18 are fitted in the insert hole is 16 in any U-shaped frame member 4' other than the outermost frame members. Thus, the latch members embrace the overall U-shaped frame members 4' to hold them, in close-contact relationship.

Figure 11:
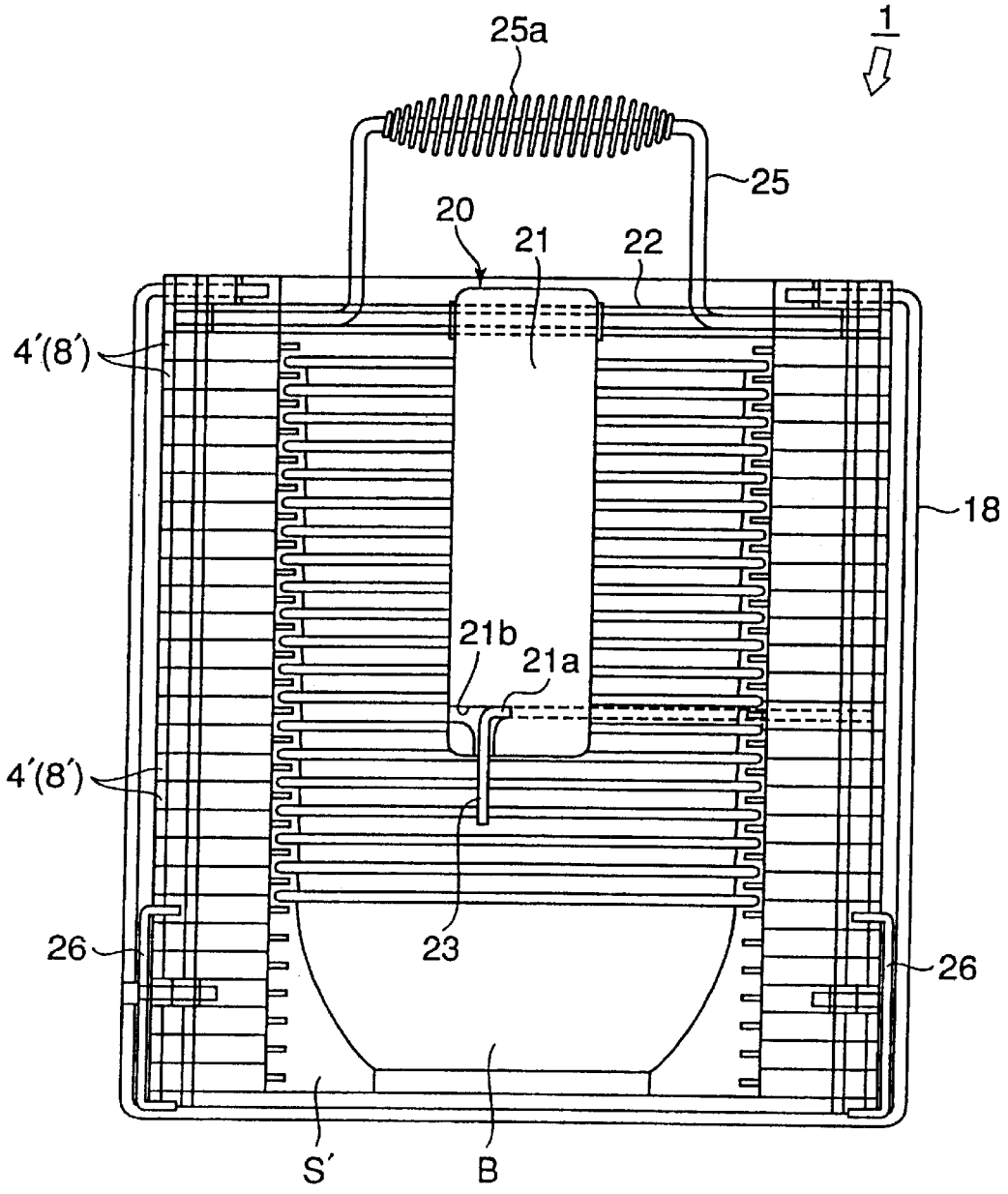
FIG. 11 is a side elevation of the dish container in accordance with the another embodiment of the present invention, which is in reduced or nested posture to contain the dishes therein for carrying, as seen looking at the side of revealing the accommodated dishes.

The dish container 1' has further a stopper means 20 to obstruct the openings (the side seen in FIG. 11) of the dish-accommodating spaces in the reduced state where the U-shaped frame members 4' come in close contact with each other as shown in FIG. 11, to thereby keep the bowls B against falling off from the dish-accommodating spaces S.

Figure 13:
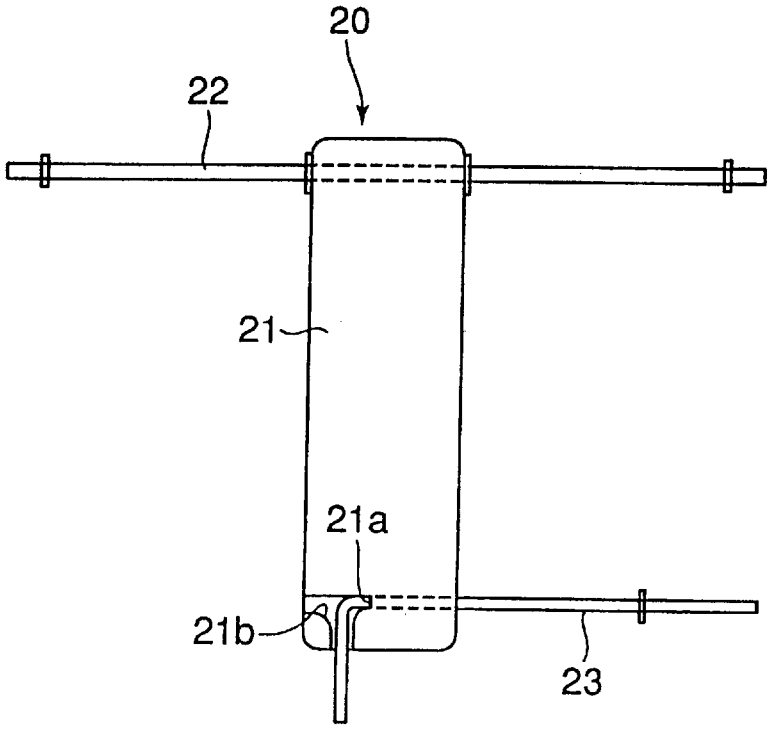
FIG. 13 is a front view showing stopper means to keep the dishes against failing away from the container.
Figure 14:
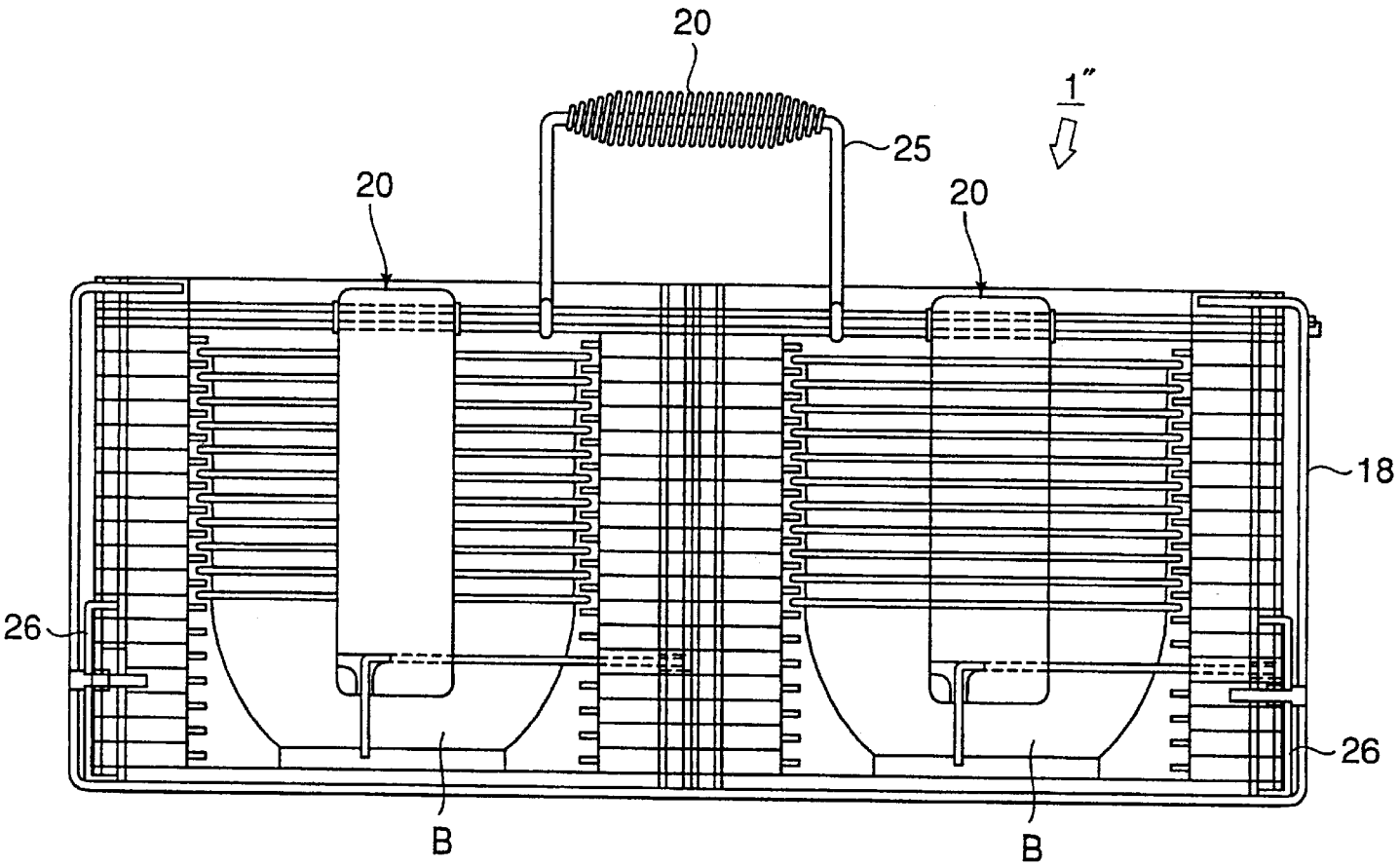
FIG. 14 is a side elevation showing a dish container of double-row type in 1 accordance with a further another embodiment of the present invention.

Referring to FIG. 13, the stopper means 20 is comprised of an elongated flat stopper plate 21, a shaft 22 connected for rotation to the stopper elate 21 at its upper edge viewed in the drawing, and a L-shaped bolt 23 connected to the lower area of the stopper plate 21, where there are formed a bore 21*a* to support the L-shaped bolt 23 for sliding as well as rotation, and a groove 21*b* to receive therein a bent portion of the L-shaped bolts 23. The shaft 22 is, as shown in FIG. 11, supported for rotation to the upper most U-shaped frame member 4' to span across the opening of the dish-accommodating space of the frame member. The stopper plate 21 is connected to the rotatable shaft 22 for rotation about the shaft 22.

Figure 12:
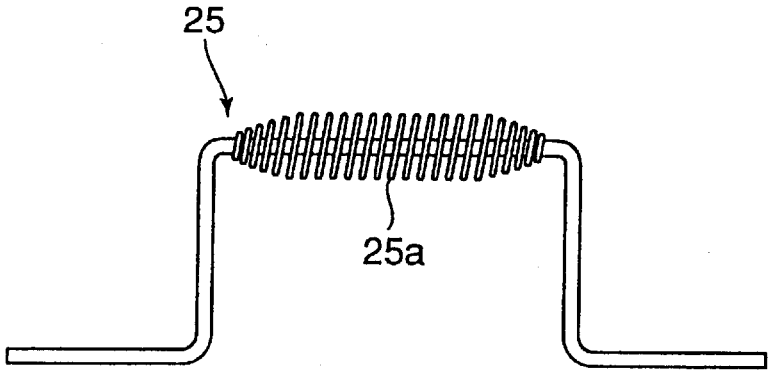
FIG. 12 is a front view showing a handle suitable for a dish container in accordance with the present invention.

Moreover, the dish container 1', as shown in FIG. 9, has a handle 25 supported for rotation in the U-shaped frame member located just below the upper most frame member. The handle 25 is provided with a coiled grip 25*a* as shown in FIGS. 11 and 12.

When using the dish container 1' constructed as described above, the dish container 1' of the reduced state is laid with the dish-accommodating spaces S' open to the stacked bowls B. Then, by moving the stacked bowls B towards the dish container 1', the bowls B are received in the dish container 1' as shown in FIG. 9.

After the stacked bowls B have been moved completely in the dish container 1', the stopper plate is made to turn to a posture where the stopper plate 21 hangs over the open side of the dish container 1' as shown in FIG. 11. Then, the L-shaped bolt 23 is moved rightwards to a location where the distal lend of the bolt 23 fits in any associated hole, not shown, in the U-shaped frame member 4' to lock up the stopper plate 21. Finally, the L-shaped bolt 23 is turned to render its bent portion fit in the groove 21*b*. In this way, the stopper means 20 obstructs the open side, viewed in the drawing, of the dish-accommodating spaces in the dish container 1' to thereby keep the bowls B against failing off.

Moreover, as shown in FIG. 9, the long sections 17*a*, 18*a* of the latch members 17, 18 are moved in engagement with the notch 19, while the hooks are fitted in the insert holes 16 so that the overall U-shaped frame members 4' are held in the reduced state. The dish container 1' is furthermore bored with the holes 15 on the upright posts 8' of the U-shaped frame members 4', in which holes 15 are fitted U-shaped retainer members 26 to keep the U-shaped frame members 4', especially, the lowest-lying U-shaped frame member 4', on the reduced state.

The dish container 1' may be carried by the operator who has grasped the coiled grip 25*a* and raised the handle 25.

For washing the bowls at the meal processing station, the operator lays the dish container 1' with the bowls B, as shown in FIG. 8, with its open side upward on the conveyor and then forces to move the outermost U-shaped frame members 4' in opposite directions till the expanded state where the bowls B in the dish container 1' are spaced apart away from each other and kept in parallel on an attitude with a little out of upright. On washing, the dishwasher sprays or jets washing liquid on the bowls B. In accordance with the arrangement described just above, the soiled bowls B may be each exposed to much washing liquid and thus washed away with more efficiency because the bowls B are kept spaced on the attitude with a little out of upright. After the completion of washing, the operator forces the outermost U-shaped frame members 4' towards each other to make the dish container reduced.

Having described embodiments of the dish container designed to accommodate a single row of stacked bowls, the present invention may be applicable to a dish container 1" of double-row type that accommodates therein two rows of the stacked bowls.

Although but the dish container 1, 1' of the present invention has been described as related to the bowls for school meal, it will be appreciated that the concept of the present invention be adaptable to other dishes such as trays and plates. In the first embodiment, the lugs 12 are shown provided at the upright posts 8 of the U-shaped frame member 4 in the first embodiment. Nevertheless, the lugs may be arranged at either the upper like members 5 or both the upright posts 8 and upper link members 5. Moreover, although the adjacent U-shaped frame members 4, 4' in the first and second embodiments described above are connected with each other by means of the sidewise opposing upper link members 5, 5' and lower link members 6, 6', it will be appreciated that only a single pair of side wise opposing link members may be sufficient to connect any adjacent U-shaped frame members with each other.

The following effects will be anticipated with the dish container constructed as described above in accordance with the present invention.

As will be understood from the above description, the dish container of the present invention maybe carried between the meal processing station and the customers, or schools, in its reduced state where the dish container is reduced in necessary volume to a minimum and, therefore, only a compact vehicle may be sufficient to transport the dish containers. In the meal processing station, the dish container may be expanded to space the soiled dishes such as bowls apart away from each other for rendering the washing ignore efficient. After the completion of the washing, the dish container may be reduced again so that a minimum space is sufficient to store the dish container. The operators do not have to touch the bowls B with their hands throughout the operations on washing at the meal processing station and the conveyance between the processing station and the institutions such as schools and thus it will be said the dish container of the present invention is superior in sanitation.

In accordance with another aspect of the present invention in which the U-shaped frame members are made so high as to conceal completely the diverse dishes, the dish container may accommodate entirely the dishes in the dish-accommodating spaces with no need of lids or covers such as the bulky upper and bottom covers. This makes it possible to further save the space required for washing and storage and no troublesome operation to open and close the covers may be necessary.

In accordance with a further another aspect of the present invention, the dish container is designed such that the dishes are kept spaced On the attitude with a little out of upright whereby the soiled dishes may be each exposed to much washing liquid sprayed from the above in the dishwasher and thus washed away with more efficiency.

Although the invention has been described in its preferred form with a certain degree of particularity, it is understood that the present disclosure of the preferred form has been changed kin details of construction and the combination and arrangement of parts may be resorted to without departing from the spirit and the scope of the invention was hereinafter claimed.

What is claimed is:

1. A dish container comprising a plurality of more than two U-shaped frame members arranged parallel to each other to define therebetween a plurality of dish-accommodating spaces;

a pair of upper and a pair of lower link members rotatable engaged between sidewise opposing positions of each pair of the frame members so that each said pair of frame members can be moved into contact with or spaced apart from each other;

support plates fixed between said pair of lower link members; and a pair of lugs on each of the frame members adapted to engage dishes in the dish-accommodating spaces, wherein the support plates and the pair of lugs said of frame members are adapted to engage a nest of dishes in the dish-accommodating spaces when said pair of frame members are moved into contact with each other and move the dishes apart when said pair of frame members are moved to be spaced apart from each other.

2. The dish container according to claim 1, further comprising latch means embracing the U-shaped frame members to keep the U-shaped frame members in a state where the U-shaped frame members are in contact with each other, and stopper means to obstruct open sides of the U-shaped frame members to keep the dishes from falling out of the dish-accommodating spaces where the dishes are received.

3. The dish container according to claim 1, wherein the U-shaped frame members are adapted to entirely a conceal the dishes in the dish-accommodating spaces.

4. The dish container according to claim 1, wherein the U-shaped frame members are made with recesses to respectively receive therein each of the upper and lower link members.

5. The dish container according to claim 1, wherein the upper and lower link members are parallel to each other.

6. The dish container according to claim 1, where axes of the upper and lower link members are respectively inclined to a plane of each of the frame members.

7. The dish container according to claim 1, wherein the pair of lugs are respectively located at opposing upper ends of the frame members and extend into the dish-accommodating spaces.

8. The dish container according to claim 4, wherein the pair of lugs are respectively located at a mid-section of the frame members and extend into the dish-accommodating spaces.

* * * * *